US008616550B2

(12) United States Patent
Ishii

(10) Patent No.: US 8,616,550 B2
(45) Date of Patent: Dec. 31, 2013

(54) SHEET TRANSPORT DEVICE AND IMAGE FORMING APPARATUS

(71) Applicant: Fuji Xerox Co., Ltd., Tokyo (JP)

(72) Inventor: Satoru Ishii, Kanagawa (JP)

(73) Assignee: Fuji Xerox Corporation, Tokyo (JP)

( * ) Notice: Subject to any disclaimer, the term of this patent is extended or adjusted under 35 U.S.C. 154(b) by 0 days.

(21) Appl. No.: 13/669,769

(22) Filed: Nov. 6, 2012

(65) Prior Publication Data

US 2013/0300054 A1 Nov. 14, 2013

(30) Foreign Application Priority Data

May 10, 2012 (JP) ..... 2012-108316

(51) Int. Cl.
*B65H 39/10* (2006.01)

(52) U.S. Cl.
USPC ..... 271/291

(58) Field of Classification Search
USPC ..... 271/291
See application file for complete search history.

(56) References Cited

U.S. PATENT DOCUMENTS 5,337,134 A * 8/1994 Sato et al. ..... 399/124
2003/0209852 A1* 11/2003 Choi ..... 271/291
2007/0036585 A1 2/2007 Ochi

FOREIGN PATENT DOCUMENTS

JP A-2007-47571 2/2007

* cited by examiner

*Primary Examiner* — David H Bollinger
(74) *Attorney, Agent, or Firm* — Oliff & Berridge, PLC

(57) ABSTRACT

Disclosed is a sheet transport device including a main body, a first transport path through which a transported sheet passes, a second transport path through which the sheet that passes through the first transport path and is reversed in a transport direction thereof passes, having a curved portion on a downstream side thereof, a first guiding member that forms a first guiding surface of the second transport path, and a second guiding member that forms a second guiding surface opposite to the guiding surface, wherein the first guiding member is supported to be rotatable between a guiding posture where the sheet is guided and an open posture that rotates from the guiding posture to open the guiding surfaces, and an interval between the first guiding member and the second guiding member in the open posture is greater than that in the guiding posture.

9 Claims, 11 Drawing Sheets

SHEET TRANSPORT DEVICE AND IMAGE FORMING APPARATUS

CROSS-REFERENCE TO RELATED APPLICATIONS

This application is based on and claims priority under 35 USC 119 from Japanese Patent Application No. 2012-108316 filed May 10, 2012.

BACKGROUND (i) Technical Field

The present invention relates to a sheet transport device and an image forming apparatus.

(ii) Related Art

In the related art, an image forming apparatus that forms an image on both sides of a sheet has been proposed. In such an image forming apparatus, while the sheet is being transported on a first transport path, an image is formed on a first side of the sheet by an image forming unit. Then, the transport direction of the sheet is reversed, and the sheet is transported on a second transport path and enters the first transport path on an upstream side with reference to the image forming unit. Then, the sheet is again transported on the first transport path, and an image is also formed on a second side of the sheet during transportation.

In many cases, in removal of the jammed sheet, a user holds the exposed part of the sheet and pulls out the remaining part thereof from the image forming apparatus.

SUMMARY

According to an aspect of the invention, there is provided a sheet transport device including: a main body; a first transport path through which a transported sheet passes; a second transport path through which the sheet that passes through the first transport path and is reversed in a transport direction thereof passes until the sheet again enters the first transport path, having a curved portion on a downstream side thereof; a first guiding member that forms a first guiding surface of the second transport path; and a second guiding member that forms a second guiding surface opposite to the first guiding surface formed by the first guiding member in the curved portion of the second transport path, wherein the first guiding member is supported to be rotatable between a guiding posture where the sheet is guided and an open posture that rotates from the guiding posture to open the guiding surfaces, and is configured so that an interval between the first guiding member and the second guiding member in the open posture is greater than that in the guiding posture.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described with reference to the accompanying drawings.

Overall configuration of image forming apparatus

Figure 1:
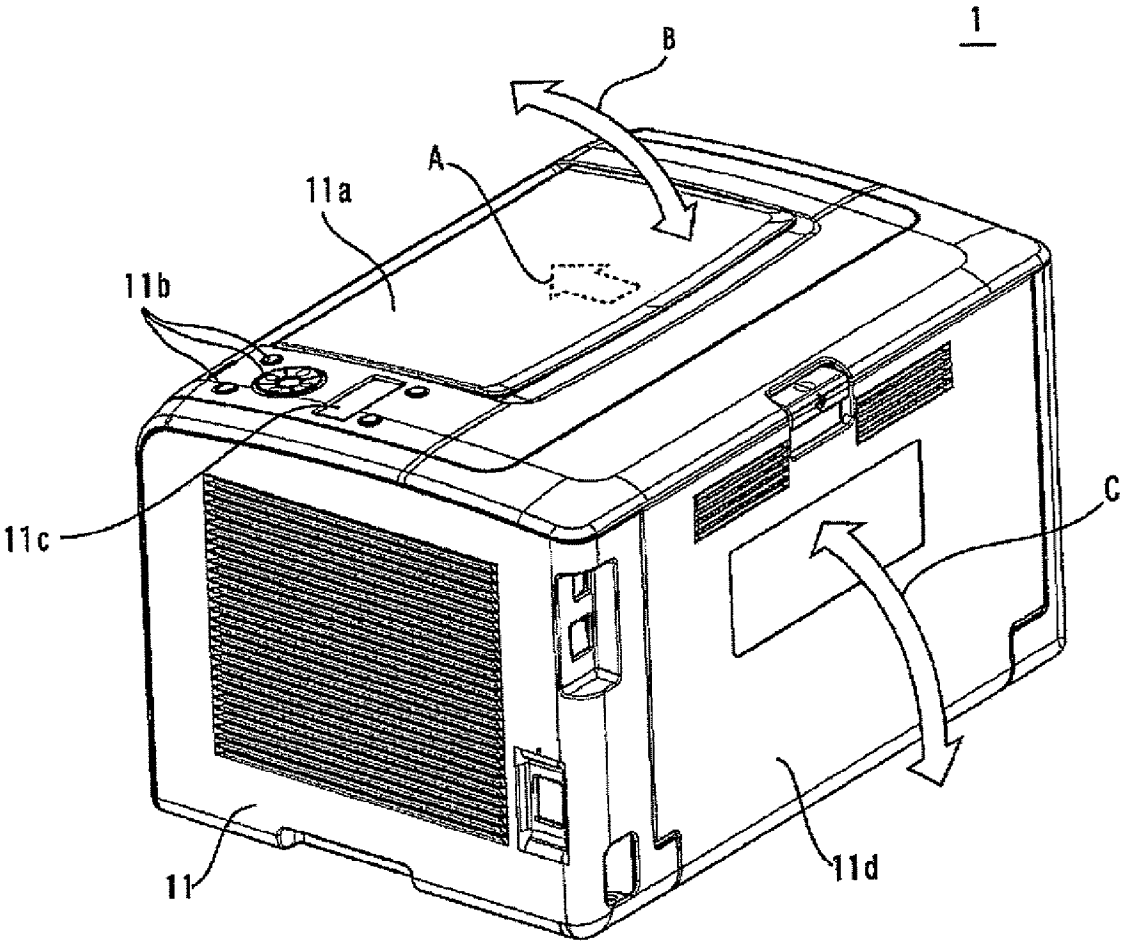
FIG. 1 is a perspective view illustrating an appearance of an image forming apparatus according to an exemplary embodiment of the present invention.

FIG. 1 is a perspective view illustrating the appearance of an image forming apparatus according to an exemplary embodiment of the invention.

An image forming apparatus 1 shown in FIG. 1 is a monochrome printer that forms an image on a sheet by electrophotography, and includes a main body 11 in which an image forming unit or the like (described later) is built.

On the upper surface of the main body 11, a cover 11*a* that covers a discharge port (described later) through which a sheet on which an image is formed is discharged in an arrow direction A is installed to be able to be opened and closed in an arrow direction B. Further, the cover 11*a* that is in an opened state functions as a stand on which the sheet discharged in the arrow direction A is disposed.

Further, on the upper surface of the main body 11, various operation buttons 11*b* operated by a user and a display screen 11*c* on which various pieces of information are displayed are provided.

Further, on a rear surface shown on the right side in the figure, of the main body 11, a rear panel 11*d* capable of being opened and closed in an arrow direction C is installed. The rear panel 11*d* is opened in a case where a sheet is jammed inside the image forming apparatus 1.

Figure 2:
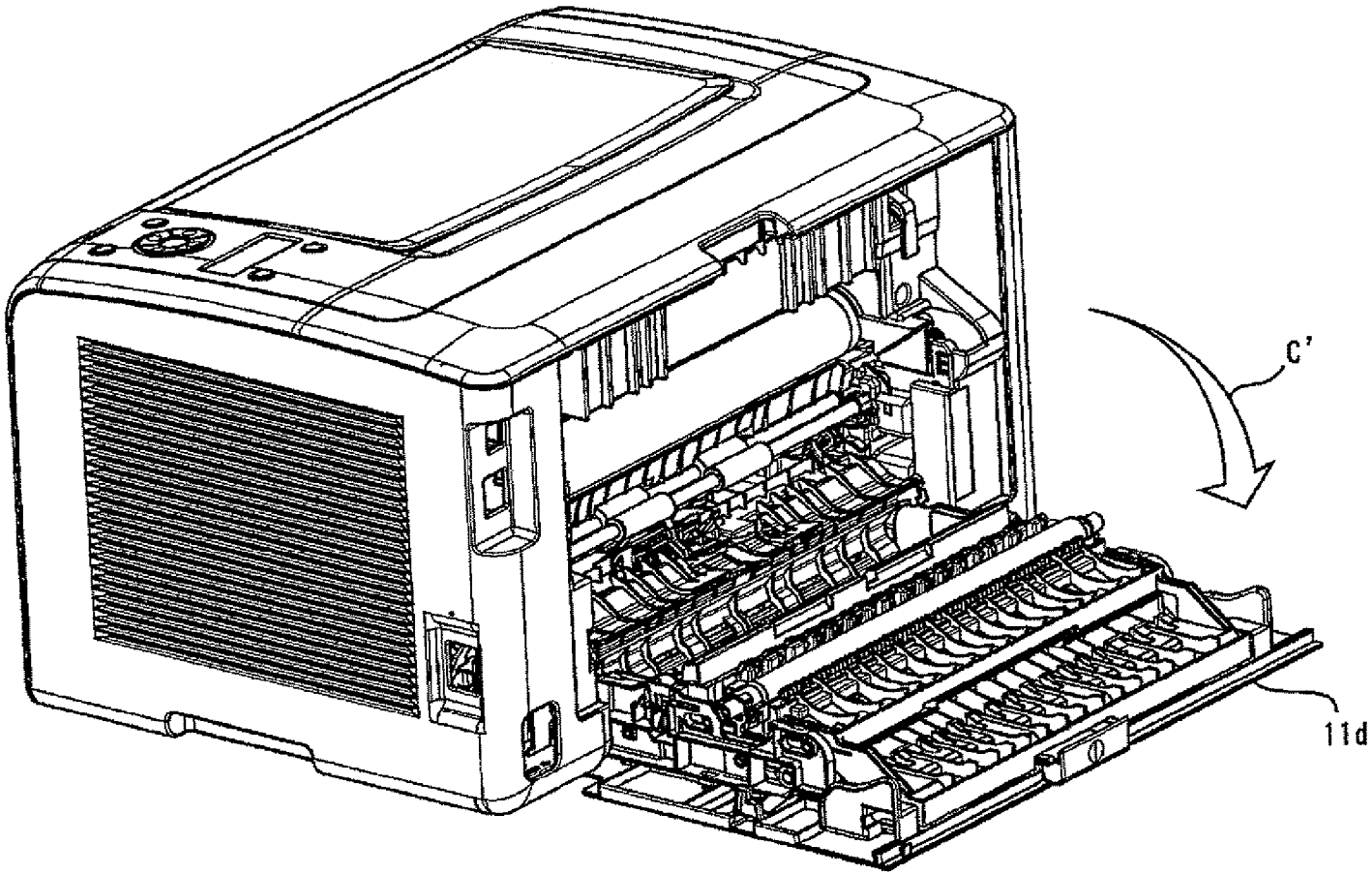
FIG. 2 is a perspective view illustrating an image forming apparatus in which a rear panel shown in FIG. 1 is opened.

FIG. 2 is a perspective view illustrating an image forming apparatus in which the rear panel shown in FIG. 1 is opened.

If the rear panel 11*d* is opened in an opening direction C', the inside of the image forming apparatus 1 is exposed, and as described below in detail, at least a part of the jammed sheet is exposed. The user holds the part of the exposed sheet and pulls out the remaining part from the image forming apparatus 1.

Figure 3:
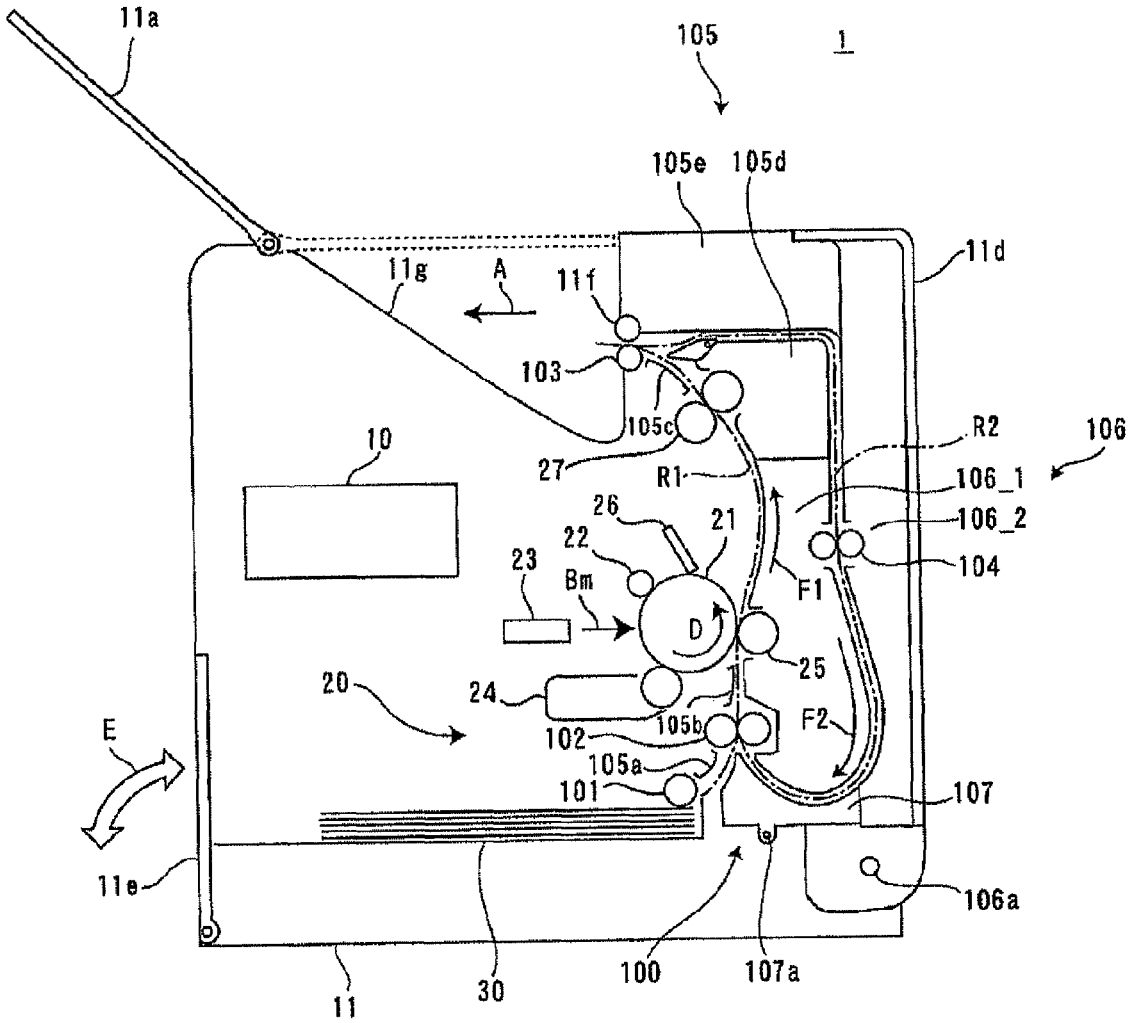
FIG. 3 is a cross-sectional view schematically illustrating an internal configuration of the image forming apparatus shown in FIG. 1.

FIG. 3 is a cross-sectional view schematically illustrating an internal configuration of the image forming apparatus shown in FIG. 1.

A controller 10, an image forming unit 20, a sheet container unit 30 and a sheet transport unit 100 are accommodated in the main body 11.

The controller 10 controls movement of each component in the image forming apparatus 1. Further, an image signal is input to the controller 10 from the outside of the image forming apparatus 1. Here, the image forming apparatus 1 is operated in a mode selected from two image forming modes of a one-sided mode in which an image is formed on only one side of a sheet and a double-sided mode in which an image is formed on both sides of the sheet. An instruction signal for instructing which image forming mode of the one-sided mode and the double-sided mode an image indicated by the image signal to be formed in is also input to the controller 10, together with the image signal. In the image forming apparatus 1, image formation based on the input image signal and instruction signal is performed under the control of the controller 10.

The image forming unit 20 forms an image on a transported sheet, and includes a photoconductor drum 21, a charger unit 22, an exposure unit 23, a developer unit 24, a transfer unit 25, a cleaning unit 26 and a fixing unit 27.

The photoconductor drum 21 has a cylindrical surface, and rotates in an arrow direction D that is around a cylindrical axis by a motor (not shown). The photoconductor drum 21 retains an electrostatic latent image and a toner image formed on the surface.

The charger unit 22 charges the surface of the photoconductor drum 21. The charger unit 22 is a charged roller that is in contact with the photoconductor drum 21 for rotation in this example, but as another example, non-contact type charging means using a corotron may be employed.

The exposure unit 23 exposes the photoconductor drum 21 to form an electrostatic latent image on the photoconductor drum 21. The exposure unit 23 scans the surface of the photoconductor drum 21 charged by the charger 22 using light beams Bm under the control of the controller 11 based on an image signal supplied from the outside, to form the latent image on the surface of the photoconductor drum 21.

The developer unit 24 develops the latent image on the photoconductor drum 21 using a toner, to form a toner image on the photoconductor drum 21.

The transfer unit 25 is a roller that rotates with a sheet being interposed between the transfer unit 25 and the photoconductor drum 21, and transfers the toner image on the photoconductor drum 21 onto the sheet.

The cleaning unit 26 is in contract with the photoconductor drum 21 and removes the toner that remains on the photoconductor drum 21 after the toner image is transferred to the sheet, to clean the photoconductor drum 21. The cleaning unit 26 is a planar blade that extends along the photoconductor drum 21.

The fixing unit 27 heats and presses the toner image transferred from the photoconductor drum 21 to be fixed on the sheet.

The sheet container unit 30 is disposed under the above-described image forming unit 20 in the image forming apparatus 1.

The sheet container unit 30 contains sheets on which images are formed.

In the image forming apparatus 1, on a front surface opposite to a rear surface on which the rear panel 11*d* is installed, a front panel 11*e* capable of being opened and closed in an arrow direction E is installed. The front panel 11*e* is opened when the sheet is supplied to the sheet container unit 30. When the sheet is supplied, the front panel 11*e* is opened by a user to expose the sheet container unit 30, and the sheet is supplied to the sheet container unit 30 by the user.

The sheet transport unit 100 transports the sheet on a first transport path R1 and a second transport path R2.

The first transport path R1 is a transport path that leads to the discharge port 11*f* from the sheet container unit 30 through a transfer position where the transfer is performed by registration roller 102 (described later) and the transfer unit 25 and a fixing position where fixing is performed by the fixing unit 27.

In a case where the image forming mode is the one-sided mode, the sheet transport unit 100 discharges the sheet transported on the first transport path R1 in the arrow direction A through the discharge port 11*f*.

The second transport path R2 is a transport path that branches off from the first transport path R1 between the discharge port 11*f* and the fixing unit 27, extends through between the first transport path R1 and the rear panel 11*d*, is curved while forming an arc, and leads to the registration roller 102 to merge into the first transport path R1.

In a case where the image forming mode is the double-sided mode, the sheet transport unit 100 first transports the sheet on the first transport path R1 in an arrow direction F1. An image is formed on a first side of the sheet while being transported on the first transport path R1. Further, the transport direction of the sheet that has the image formed on the first side and passes through the fixing position is reversed, and the sheet is transported on the second transport path R2 in an arrow direction F2. Further, the sheet transport unit 100 transports the sheet transported on the second transport path R2 to the registration roller 102 on an upstream side with reference to the transfer position. Then, the sheet is again sent to the first transport path R1 by the registration roller 102. Further, the sheet is transported on the first transport path R1 with the second side facing the photoconductor drum 21. Further, while the sheet is being transported on the first transport path R1 for the second time, an image is formed on the second side of the sheet. The sheet on which the images are formed on both sides in this way is discharged through the discharge port 11*f*.

The sheet transport unit 100 includes an extracting roller 101, the registration roller 102, a discharge roller 103, reversal transport roller 104, a fixed guiding member 105, a first movable guiding member 106 and a second movable guiding member 107.

The extracting roller 101 extracts a sheet from the sheet container unit 30 one by one, and transports the sheet to the registration roller 102 on the first transport path R1.

The registration roller 102 transport the sheet to the transfer position on the first transport path R1 according to the time when the toner image is formed on the photoconductor drum 21.

The discharge roller 103 discharges the sheet that is transported on the first transport path R1 and passes through the fixing position to the outside of the image forming apparatus 1. The sheet discharged by the discharge roller 103 is discharged on a discharge stand 11*g* installed on an upper part of the image forming apparatus 1 and on the cover 11*a* that is opened. The discharge roller 103 reversely rotates in a state where the sheet is transported halfway in the double-sided mode, to transport the sheet onto the second transport path R2.

The reversal transport roller 104 transport the sheet transported by the reverse rotation of the discharge roller 103 toward the registration roller 102 on the second transport path R2 in an arrow direction F2.

The fixed guiding member 105 is a member fixed to the main body 11, and includes a first fixed guiding member 105*a*, a second fixed guiding member 105*b*, a third fixed guiding member 105*c*, a fourth fixed guiding member 105*d* and a fifth fixed guiding member 105*e*.

The first fixed guiding member 105*a* is disposed between the extracting roller 101 and the registration roller 102. The first fixed guiding member 105*a* faces the second movable guiding member 107 with the first transport path R1 being opened therebetween. Further, the first fixed guiding member 105*a* guides the sheet extracted by the extracting roller 101 to the registration roller 102 on the first transport path R1 in cooperation with the second movable guiding member 107.

The second fixed guiding member 105*b* is disposed between the registration roller 102 and the fixing position. The second fixed guiding member 105*b* faces the first movable guiding member 106 with the first transport path R1 being opened therebetween. Further, the second fixed guiding member 105*b* guides the sheet transported by the registration roller 102 to the transfer position on the first transport path R1 in cooperation with the first movable guiding member 106.

The third fixed guiding member 105*c* is disposed between the fixing roller 27 and the discharge roller 103. The third fixed guiding member 105*c* guides therealong the sheet subject to fixation by the fixing roller 27 and transported to the discharge roller 103 on the first transport path R1.

The fourth fixed guiding member 105*d* is disposed on an upper side of the inside of the main body 11 and supports the fixing roller 27. The fourth fixed guiding member 105*d* guides therealong the sheet to the fixing roller 27 on the first transport path R1. The fourth fixed guiding member 105*d* faces each of the fifth fixed guiding members 105*e* and the first movable guiding member 106 with the second transport path R2 being opened therebetween.

Further, the fourth fixed guiding member 105*d* guides the sheet transported by the reverse rotation of the discharge roller 103 on the second transport path R2 in cooperation with the fifth fixed guiding member 105*e* and the first movable guiding member 106.

The fifth fixed guiding member 105*e* faces the fourth fixed guiding member 105*d* above the fourth fixed guiding member 105*d* with the second transport path R2 being opened therebetween. The fifth fixed guiding member 105*e* guides the sheet transported by the reverse rotation of the discharge roller 103 on the second transport path R2 in cooperation with the fourth fixed guiding member 105*d*.

The first movable guiding member 106 guides the transported sheet on the first transport path R1, and guides the sheet that is reversed and returned to the registration roller 102 on the second transport path.

Further, the first movable guiding member 106 is supported to be able to rotate around a first rotation shaft 106*a* that extends in a direction that is across the transport direction of the sheet between a guiding posture and an open posture, in a lower part of the main body 11. The guiding posture is a posture shown in FIG. 3 where the sheet is guided as described above. The open posture is a posture that rotates from the guiding posture where the first transport path R1 is opened on the side of the first movable guiding member 106. The open posture will be described later in detail.

Here, the rear panel 11*d* is fixed to the first movable guiding member 106, and thus, rotation of the rear panel 11*d* in the arrow direction C shown in FIGS. 1 and 2 is the same as rotation of the first movable guiding member 106 between the guiding posture and the open posture.

The first movable guiding member 106 includes an inner part 106_1 and an outer part 106_2 that face each other with the second transport path R2 being opened therebetween.

When the first movable guiding member 106 is in the guiding posture, the inner part 106_1 faces the second fixed guiding member 105*b* with the first transport path R1 being opened therebetween. Further, the inner part 106_1 guides the sheet transported by the registration roller 102 to the transfer position on the first transport path R1 in cooperation with the second fixed guiding member 105*b*. Further, the inner part 10_61 guides therealong the sheet passed through the transfer position to the fourth fixed guiding member 105*d* on the first transport path R1.

Further, when the first movable guiding member 106 is in the guiding posture, the inner part 106_1 guides the sheet that is reversed and returned to the registration roller 102 on the second transport path R2.

Here, as described above, the second transport path R2 is curved while forming an arc, and leads to the registration roller 102 to merge into the first transport path R1. When the first movable guiding member 106 is in the guiding posture, the inner part 106_1 forms a guiding surface of the second transport path R2 that faces the concave surface of the guided sheet, in a curved portion where the second transport path R2 forms the arc.

Further, when the first movable guiding member 106 is in the guiding posture, the inner part 106_1 faces the second movable guiding member 107 with the second transport path R2 being opened therebetween, in the curved portion where the second transport path R2 forms the arc. Further, in the curved portion, the inner part 106_1 guides the sheet to the registration roller 102 on the second transport path R2 in cooperation with the second movable guiding member 107.

When the first movable guiding member 106 is in the guiding posture, the outer part 106_2 faces the fourth fixed guiding member 105*d* with the second transport path R2 being opened therebetween. The outer part 106_2 continuously guides the sheet passed through the second transport path R2 between the fourth fixed guiding member 105*d* and the fifth fixed guiding member 105*e* on the second transport path R2 in cooperation with the fourth fixed guiding member 105*d*.

Further, the outer part 106_2 faces the inner part 106_1 with the second transport path R2 being opened therebetween, up to the downstream side of the reversal transport roller 104. Further, the outer part 106_2 guides the sheet to the downstream side of the reversal transport roller 104 on the second transport path R2 in cooperation with the inner part 106_1. From the downstream side of the reversal transport roller 104, the inner part 106_1 and the second movable guiding member 107 guides the sheet to the registration roller 102 on the second transport R2 in cooperation with each other.

Here, the reversal transport roller 104 are supported by the inner part 106_1 and the outer part 106_2. Further, the transfer unit 25 is supported by the inner part 106_1. Thus, when the first movable guiding member 106 rotates from the guiding posture shown in FIG. 3 to the open posture (described later), the reversal transport roller 104 and the transfer unit 25 move together with the first movable guiding member 106.

The second movable guiding member 107 is supported to be able to rotate around a second rotation shaft 107*a* close to the curved portion where the second transport path R2 forms the arc, compared with the first rotation shaft 106*a* of the first movable guiding member 106 which extends in a direction that is across the transport direction of the sheet in a lower part of the apparatus main body 11.

When the first movable guiding member 106 is in the guiding posture, the second movable guiding member 107 is supported by the first movable guiding member 106, and faces the inner part 106_1 with the second transport path R2 being opened therebetwen. That is, the second movable guiding member 107 in the guiding posture forms an opposite guiding surface that faces the guiding surface on the inner part 106_1 of the second transport path R2.

Further, when the second movable guiding member 107 is in the guiding posture, the second movable guiding member 107 faces the first fixed guiding member 105*a* with the first transport path R1 with being opened therebetween. That is, the second movable guiding member 107 in the guiding posture forms a guiding surface of an upstream transport path of the first transport path R1 on an upstream side with reference to the registration roller 102. An opposite guiding surface of the upstream transport path is formed by the first fixed guiding member 105*a*.

In the present exemplary embodiment, the second movable guiding member 107 functions as a guiding member that forms the guiding surface of the second transport path R2, and simultaneously, a guiding member that forms the guiding surface of the upstream transport path of the first transport path R1. However, differently from the present exemplary embodiment, these two guiding members may be individually provided.

A posture where the second movable guiding member 107 faces the inner part 106_1 of the first movable guiding member 106 with the second transport path R2 being opened therebetween and faces the first fixed guiding member 105*a* with the first transport path R1 being opened therebetween is referred to as a guiding posture of the second movable guiding member 107.

When the second movable guiding member 107 is in the guiding posture, the second movable guiding member 107 guides the sheet extracted by the extracting roller 101 to the registration roller 102 on the first transport path R1 in cooperation with the first fixed guiding member 105*a*.

Further, when the second movable guiding member 107 is in the guiding posture, the second movable guiding member 107 guides the sheet transported on the second transport path R2 to the registration roller 102 on the second transport path R2 in cooperation with the inner part 1061 of the first movable guiding member 106.

A basic operation of the image forming apparatus 1 shown in FIG. 1 will be described.

In the image forming unit 20, the photoconductor drum 21 rotates in the arrow direction D, and electric charges are applied on the surface of the photoconductor drum 21 by the charger unit 22. The exposure unit 23 performs irradiation onto the surface of the photoconductor drum 21 with exposure light based on an image signal supplied from the outside to form an electrostatic latent image on the surface of the photoconductor drum 21. The photoconductor drum 21 rotates while retaining the electrostatic latent image.

The developer unit 24 develops the electrostatic latent image on the photoconductor drum 21 with a toner to form a toner image. The photoconductor drum 21 rotates while retaining the toner image formed by the developer unit 24.

The sheet accommodated in the sheet container unit 30 is extracted by the extracting roller 101, and is transported to the transfer unit 25 by the registration roller 102 on the first transport path R1. The sheet is sent to the transfer position by the registration roller 102 according to the time when the toner image is formed on the photoconductor drum 21. The transfer unit 25 applies a bias voltage for transfer between the photoconductor drum 21 and the sheet, to transfer the toner image of the photoconductor drum 21 on the sheet. After transfer by means of the transfer unit 25, the toner remaining on the photoconductor drum 21 is removed by the cleaning unit 26. The sheet on which the toner image is transferred by the transfer unit 25 is transported to the fixing unit 27, so that the transferred toner image is fixed on the sheet. In this way, the image is formed on the sheet.

In a case where the image forming mode is the one-sided mode, the sheet on which the image is formed is discharged on the discharge stand 11*g* and the opened cover 11*a* by the discharge roller 103.

In a case where the image forming mode is the double-sided mode, the transport direction of the sheet on which the image is formed on the first side is reversed by the discharge roller 103 and the sheet is transported to the registration roller 102 on the second transport path R2. Further, the sheet is again sent to the first transport path R1 by the registration roller 102. Further, the sheet is transported on the first transport path R1 with the second side thereof facing the photoconductor drum 21. Further, while the sheet is being transported on the first transport path R1 for the second time, an image is formed on the second side of the sheet. The sheet on which the images are formed on the both sides in this way is discharged by the discharge roller 103.

Removal of Sheet when Sheet is Jammed

Here, in a case where the sheet is jammed inside the image forming apparatus 1 while being transported, the rear panel 11*d* is opened in an opening direction C' (see FIG. 2) as described above.

Hereinafter, a method of removing the sheet when the sheet is jammed will be described.

The rear panel 11*d* is fixed to the outer part 106_2 of the first movable guiding member 106, and the rear panel 11*d* and the first movable guiding member 106 are integrally formed. Thus, opening of the rear panel 11*d* means that the first movable guiding member 106 rotates around the first rotation shaft 106*a*.

Figure 4:
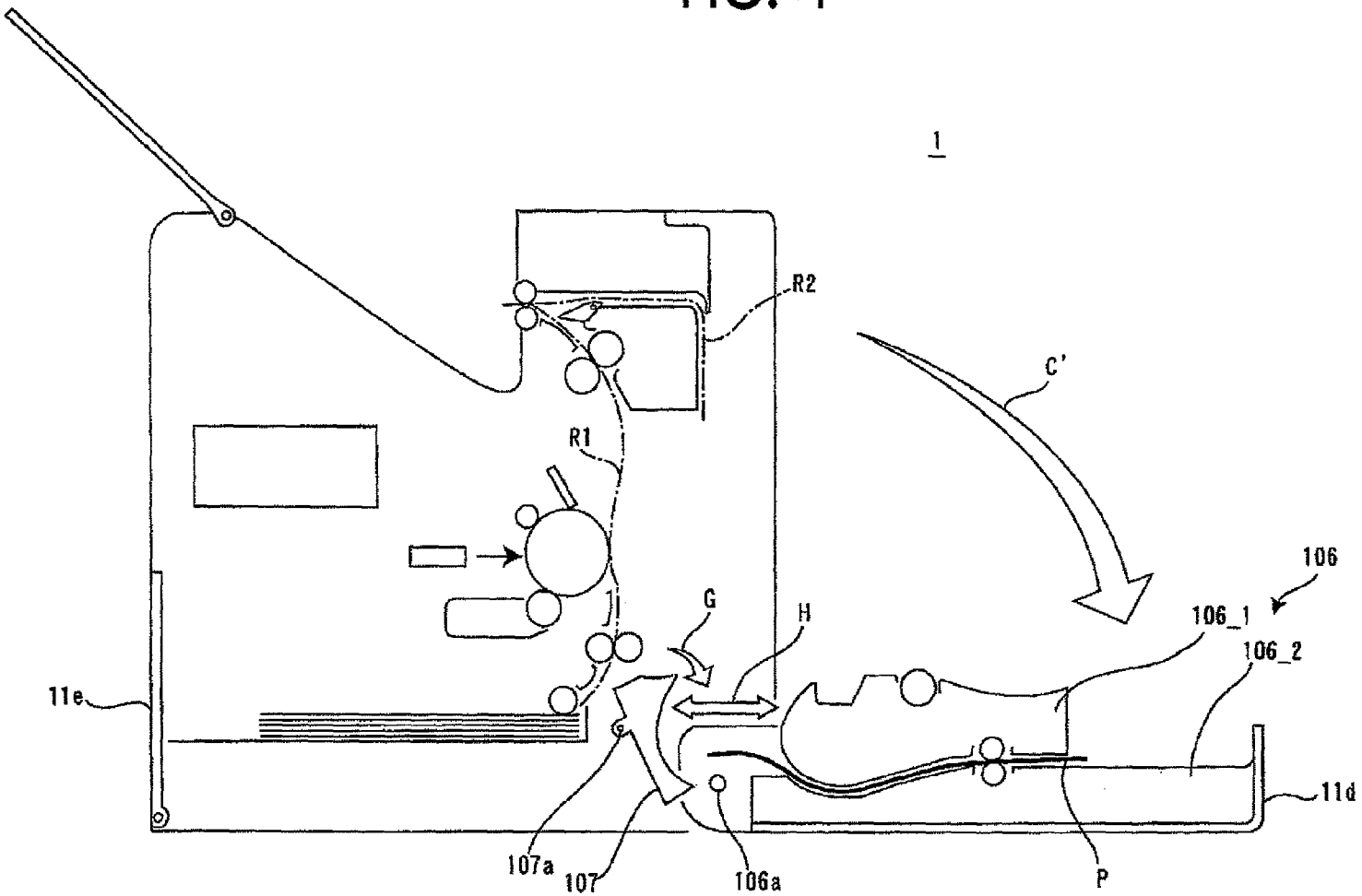
FIG. 4 is a diagram illustrating an image forming apparatus in a state where a rear panel is opened and a first movable guiding member rotates when a sheet is jammed during transportation, using the same cross-section as in FIG. 3.

FIG. 4 is a diagram illustrating the image forming apparatus in a state where the rear panel is opened and the first movable guiding member rotates in a case where the sheet is jammed while being transported, at the same cross-section as that in FIG. 3.

FIG. 4 shows an example in which a sheet P is jammed on the second transport path R2 while being transported.

As shown in FIG. 4, the rear panel 11*d* and the first movable guiding member 106 rotate together in the opening direction C' around the first rotation shaft 106*a*.

If the first movable guiding member 106 rotates, the first transport path R1 on the side of the first movable guiding member 106 is opened. The posture in which the first transport path R1 on the side of the first movable guiding member 106 is opened corresponds to an open posture of the first movable guiding member 106.

In the present exemplary embodiment, the second movable guiding member 107 has the center of gravity shifted toward the rear panel 11*d* so that a part thereof near the side of the rear panel 11*d* with reference to the second rotation shaft 107*a* is heavier than a part thereof near the inside of the main body 11 with reference to the second rotation shaft 107*a*.

Thus, if the first movable guiding member 106 rotates to the open posture, the second movable guiding member 107 loses its support and rotates around the second rotation shaft 107*a* due to its own weight in an arrow direction G, that is, to the side of the rear panel 11*d* from the guiding posture shown in FIG. 3, due to the shifted center of gravity. The posture of the rotated second movable guiding member 107 is referred to as an open posture of the second movable guiding member 107.

Here, the first rotation shaft 106*a* of the first movable guiding member 106 is separated distantly from the curved portion where the second transport path R2 forms the arc shown in FIG. 2, compared with the second rotation shaft 107*a* of the second movable guiding member 107. Thus, if the first movable guiding member 106 rotates around the first rotation shaft 106*a* and the second movable guiding member 107 rotates around the second rotation shaft 107*a*, an interval between the first movable guiding member 106 and the second movable guiding member 107 increases in an arrow direction H due to a position difference of the rotation shafts.

When the first movable guiding member 106 and the second movable guiding member 107 are in the guiding posture shown in FIG. 3, in many cases, a part of the sheet P jammed on the second transport path R2 hangs on the curved portion of the second transport path R2 where the arc is formed.

Here, differently from the present exemplary embodiment, assuming that the interval between the first movable guiding member 106 and the second movable guiding member 107 is maintained when the first movable guiding member 106 rotates to the open posture, it is necessary to pull out the jammed sheet P from the second transport path R2 including the curved portion where the arc is formed.

On the other hand, in the present exemplary embodiment, when the first movable guiding member 106 rotates to the open posture, the interval between the first movable guiding member 106 and the second movable guiding member 107 increases in the arrow direction H as described above. As a result, the part of the sheet P that hangs on the curved portion where the arc is formed when the first movable guiding member 106 and the second movable guiding member 107 are in the guiding posture extends. Further, when a user removes the sheet P, the user pulls out the sheet P from a portion of the second transport path R2, having a shape similar to a straight line, excluding the curved portion where the arc is formed. Pulling resistance when the sheet P is pulled out from such a portion having the shape similar to the straight line is suppressed, compared with pulling resistance when the sheet P is pulled out from the second transport path R2 including the curved portion where the arc is formed in the above-described assumption.

Further, in the present exemplary embodiment, the second movable guiding member 107 forms the guiding surface of the upstream transport path of the first transport path R1 on the upstream side with reference to the registration roller 102, as described above. Further, if the second movable guiding member 107 rotates as the first movable guiding member 106 rotates to the open posture, the guiding surface on the upstream transport path is opened.

Here, when the sheet is jammed on the first transport path R1, a part of the sheet may catch on the upstream transport path. In the present exemplary embodiment, if the rear panel 11*d* is opened, the second movable guiding member 107 rotates, and thus, the guiding surface on the upstream transport path is opened.

Thus, in the present exemplary embodiment, pulling resistance when the sheet is caught and jammed on the upstream transport path is pulled out from the first transport path R1 including the upstream transport path is suppressed, compared with a case where the guiding surface on the upstream transport path is not opened.

Here, in the present exemplary embodiment, as a method of pulling out the sheet jammed on the first transport path R1 in a state of hanging on the upstream transport path, the following two methods may be used. One is a method of pulling out the sheet from the rear panel 11*d*. This method is employed in a case where a large part of the sheet is visually confirmed from the rear panel 11*d* as only a lower end of the jammed sheet hangs on the upstream transport path. The other is a method of opening the front panel 11*e* configured to be opened when the sheet is supplied to the sheet container unit 30 and pulling out the sheet from the front panel 11*e*. In a case where the sheet is jammed immediately after being extracted from the sheet container unit 30, the most part of the jammed sheet is present on the side of the sheet container unit 30, and thus, the sheet may not be easily recognized from the side of the rear panel 11*d*. In this case, the front panel 11*e* is opened and the sheet is pulled out from the side of the front panel 11*e*.

Hereinafter, specific shapes of the guiding posture and the open posture of the first movable guiding member 106 and the second movable guiding member 107 will be described in detail with reference to the accompanying drawings.

Figure 5:
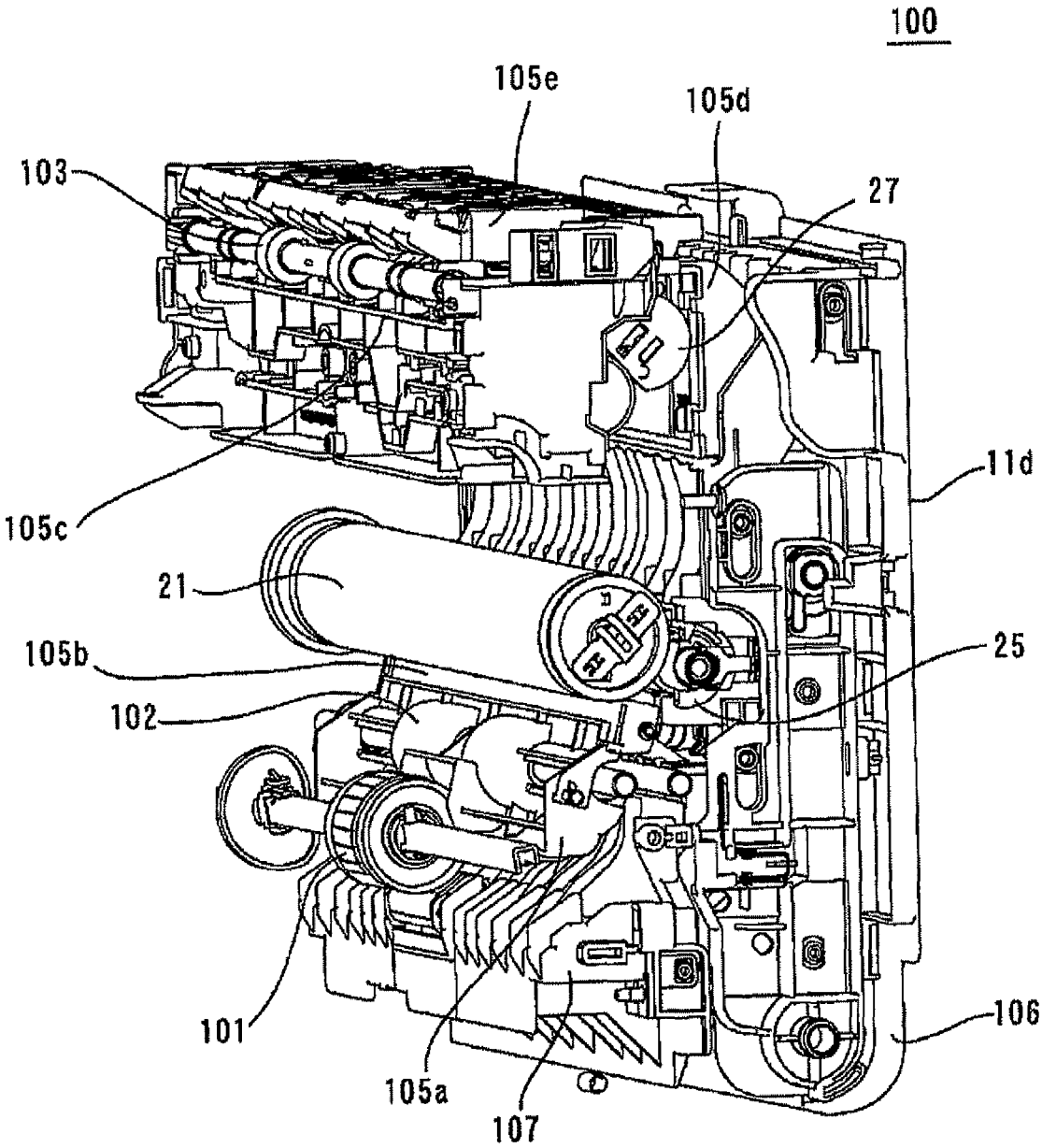
FIG. 5 is a perspective view illustrating a sheet transport unit when a first movable guiding member and a second movable guiding member are in a guiding posture, when seen in a direction that directs from the inside of a main body toward a rear panel.

FIG. 5 is a perspective view illustrating the sheet transport unit when the first movable guiding member and second movable guiding member are in the guiding posture, when seen in a direction that directs from the inside of the main body toward the rear panel.

In FIG. 5, the sheet transport unit 100 when the first movable guiding member 106 and the second movable guiding member 107 are in the guiding posture is shown together with the photoconductor drum 21, the transfer unit 25 and the fixing unit 27.

In FIG. 5, the above-described part of the first movable guiding member 106 and the second movable guiding member 107 on the first transport path R1 is shown.

The sheet transported by the extracting roller 101 is guided to the registration roller 102 in a region (first transport path R1) interposed between the first fixed guiding member 105*a* and the second movable guiding member 107. Then, the sheet transported by the registration roller 102 is guided to the transfer position disposed between the photoconductor drum 21 and the transfer unit 25 in a region (first transport path R1) interposed between the second fixed guiding member 105*b* and the first movable guiding member 106.

The sheet passed through the transfer position is guided to the fixing unit 27 along the first movable guiding member 106. Further, the sheet passed through the fixing unit 27 is guided to the discharge roller 103 along the third fixed guiding member 105*c*.

In a case where the image forming mode is the one-sided mode, the sheet is discharged onto the discharge stand 11*g* shown in FIG. 3 and the opened cover 11*a*, through the discharge roller 103 at a stage where an image is formed on one side of the sheet. On the other hand, in a case where the image forming mode is the double-sided mode, the transport direction of the sheet in which the image is formed on one side (first side) is reversed by the discharge roller 103, and the sheet is transported to the registration roller 102 on the second transport path R2 that forms the arc on the downstream side. Further, the sheet is again sent to the first transport path R1 by the registration roller 102. Further, the sheet is transported on the first transport path R1 with the second side facing the photoconductor drum 21. Further, while the sheet is being transported on the first transport path R1 for the second time, an image is formed on the second side of the sheet. The sheet in which the images are formed on the both sides in this way is discharged through the discharge roller 103. Here, in FIG. 5, the second transport path R2 is not shown.

On the side of the first transport path R1, the first movable guiding member 106 and the second movable guiding member 107 have a structure in which plural ribs that extend in the transport direction of the sheet are arranged in a direction that is across the transport direction. In FIG. 5, although the second transport path R2 is not shown, also on the side of the second transport path R2, the first movable guiding member 106 and the second movable guiding member 107 also have a structure in which plural ribs are arranged.

Figure 6:
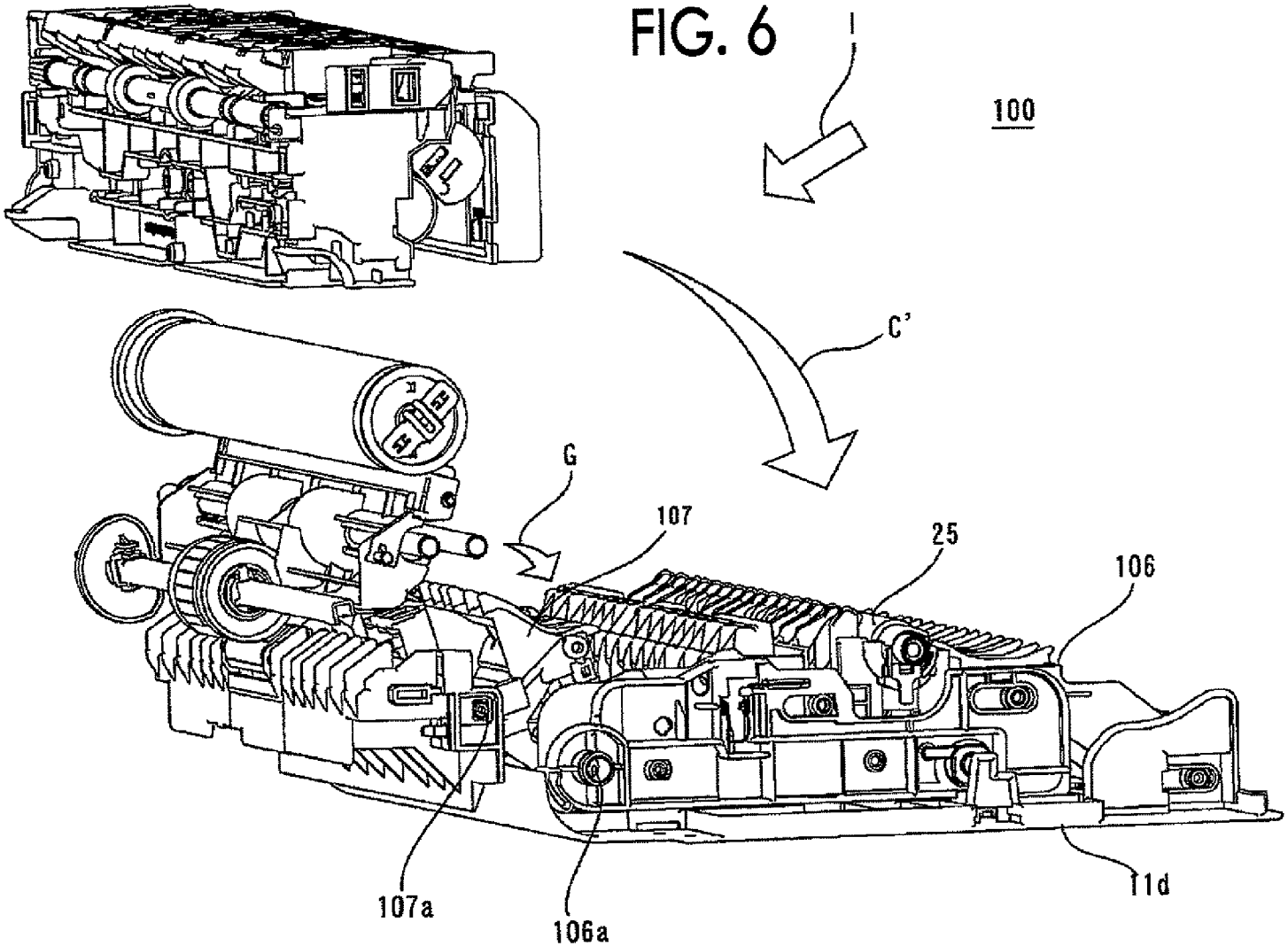
FIG. 6 is a perspective view illustrating the sheet transport unit when the first movable guiding member and the second movable guiding member are in an open posture, when seen in the same direction as in FIG. 5.
Figure 7:
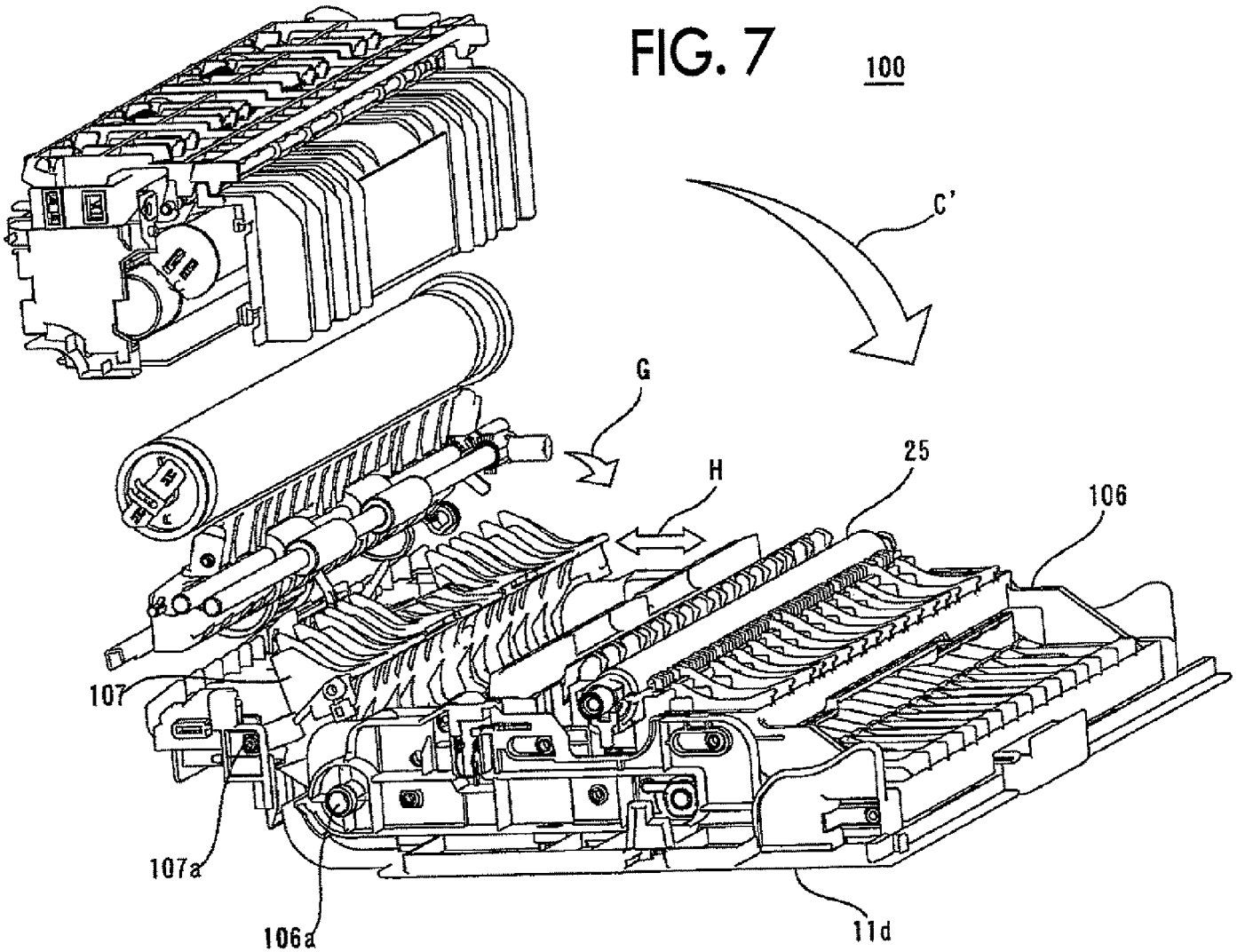
FIG. 7 is a perspective view illustrating the sheet transport unit when the first movable guiding member and the second movable guiding member are in the open posture, when seen in a direction of arrow I in FIG. 6.

FIG. 6 is a perspective view illustrating the sheet transport unit when the first movable guiding member and the second movable guiding member are in the open posture, when seen in the same direction as in FIG. 5. Further, FIG. 7 is a perspective view illustrating the sheet transport unit when the first movable guiding member and the second movable guiding member are in the open posture, when seen in an arrow direction I in FIG. 6.

If the rear panel 11*d* is opened in the opening direction C', the first movable guiding member 106 to which the rear panel 11*d* is fixed also rotates to the open posture around the first rotation shaft 106*a*. Since the transfer unit 25 is supported by the first movable guiding member 106, the transfer unit 25 moves together when the first movable guiding member 106 rotates.

Further, at that time, the second movable guiding member 107 of which the center of gravity is shifted to the side of the rear panel 11*d*, supported by the first movable guiding member 106 that is in the guiding posture, loses its support, and rotates around the second rotation shaft 107*a* in the arrow direction G to the open posture due to its own weight.

Further, due to the position difference between the first rotation shaft 106*a* and the second rotation shaft 107*a* with respect to the first movable guiding member 106, the interval between the first movable guiding member 106 and the second movable guiding member 107 increases in the arrow direction H of the second transport path R2 in the curved portion where the arc is formed shown in FIG. 2. Further, at that time, the guiding surface formed by the second movable guiding member 107 on the upstream transport path of the first transport path R1 on the upstream side with reference to the registration roller 102 is opened.

In the present exemplary embodiment, if the first movable guiding member 106 rotates to the open posture, a structure is provided in which the second movable guiding member 107 rotates to the open posture due to the shifted center of gravity, and thus, the interval between the members due to the position difference of the rotation shafts of the respective members increases. Here, the structure in which the second movable guiding member 107 rotates to increase the interval between the members when the first movable guiding member 106 rotates to the open posture is not limited to the structure of the present exemplary embodiment. For example, a structure may be used in which the first movable guiding member 106 and the second movable guiding member 107 are connected to each other by a link mechanism and the second movable guiding member 107 rotates to increase the interval between the members when the first movable guiding member 106 rotates to the open posture. In the present exemplary embodiment, a simple structure is achieved, compared with a case where such a link mechanism is used.

Shape of Second Movable Guiding Member

Hereinafter, the shape of the second movable guiding member 107 will be described in detail.

Figure 8:
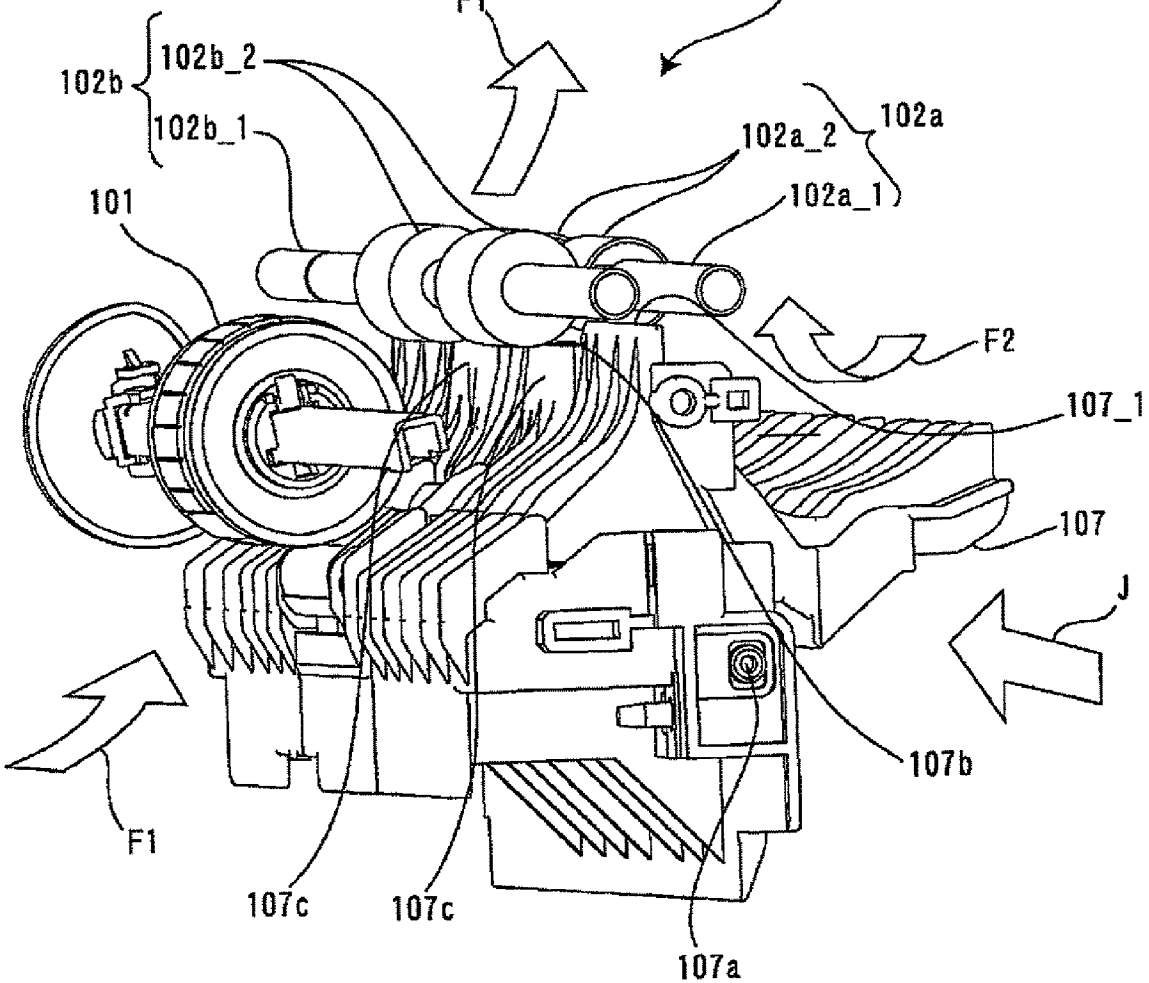
FIG. 8 is a perspective view illustrating the second movable guiding member in the guiding posture shown in FIG. 5, when seen in a direction that directs from the inside of the main body toward the rear panel.

FIG. 8 is a perspective view illustrating the second movable guiding member in the guiding posture shown in FIG. 5, when seen in a direction that directs from the inside of the main body toward the rear panel.

Before description of the shape of the second movable guiding member 107, first, the registration roller 102 to which the sheet is guided by the second movable guiding member 107 will be described.

In FIG. 8, the second movable guiding member 107 in the guiding posture is shown together with the extracting roller 101 and the registration roller 102.

Here, the registration roller 102 corresponds to a transport unit that includes a first transport member 102*a* and a second transport member 102*b*.

The first transport member 102*a* includes a first shaft member 102*a*_1 and two first rollers 102*a*_2.

The first shaft member 102*a*_1 extends in an axial direction that is across both of the transport direction F1 on the first transport path R1 (see FIG. 3) and the transport direction F2 on the second transport path R2 (see FIG. 3), and is supported by the main body 11 shown in FIGS. 1 and 2, for example.

Two first rollers 102*a*_2 are fixed to the first shaft member 102*a*_1 at an interval in the axial direction.

The number of the first rollers 102*a*_2 in the first transport member 102*a* is not limited to two in the present exemplary embodiment, and may be three or more.

The second transport member 102*b* includes a second shaft member 102*b*_1 and two second rollers 102*b*_2.

The second shaft member 102*b*_1 extends in an axial direction that is across both of the transport direction F1 on the first transport path R1 and the transport direction F2 on the second transport path R2, in a similar way to the first shaft member 102*a*_1, and is supported by the main body 11.

Two second rollers 102*b*_2 are fixed in positions on the second shaft members 102*b*_1 for contact with two first rollers 102*a*_2 one-to-one.

With respect to the second transport member 102*b*, in the present exemplary embodiment, an example in which two second rollers 102*b*_2 are in contact with two first rollers 102*a*_2 one by one is shown. However, the second transport member 102*b* is not limited thereto, and one roller having a length being in contact with both of the two first rollers 102*a*_2 may be used.

The first transport member 102*a* and the second transport member 102*b* are rotated by a motor (not shown) to transport the sheet on the first transport path R1 in the transport direction F1 in cooperation with each other with the sheet interposed between two first rollers 102*a*_2 and two second rollers 102*b*_2.

Further, the rotation of the first transport member 102*a* and the second transport member 102*b* is performed according to the time when the toner image is formed on the photoconductor drum 21 shown in FIG. 3. Thus, the registration roller 102 transport the sheet on the first transport path R1 to the transfer position according to the time when the toner image is formed on the photoconductor drum 21.

The second movable guiding member 107 guides the sheet transported in the transport direction F1 on the first transport path R1 or the sheet transported in the transport direction F2 on the second transport path R2 to between the first transport member 102*a* and the second transport member 102*b*.

Further, the sheet transported in the transport direction F1 or the sheet transported in the transport direction F2 is curved according to the shape of the first transport path R1 and the shape of the second transport path R2, respectively. The second movable guiding member 107 performs guiding while being in contact with the convex surface side of the curved sheet.

Here, the second movable guiding member 107 has an end edge 107_1 that extends in the axial direction where the first shaft member 102*a*_1 and the second shaft member 102*b*_1 extend, in the guiding posture where the second movable guiding member 107 is adjacent to the registration roller 102. Further, at the end edge 107_1 of the second movable guiding member 107, the following two notches 107*b* are provided.

Figure 9:
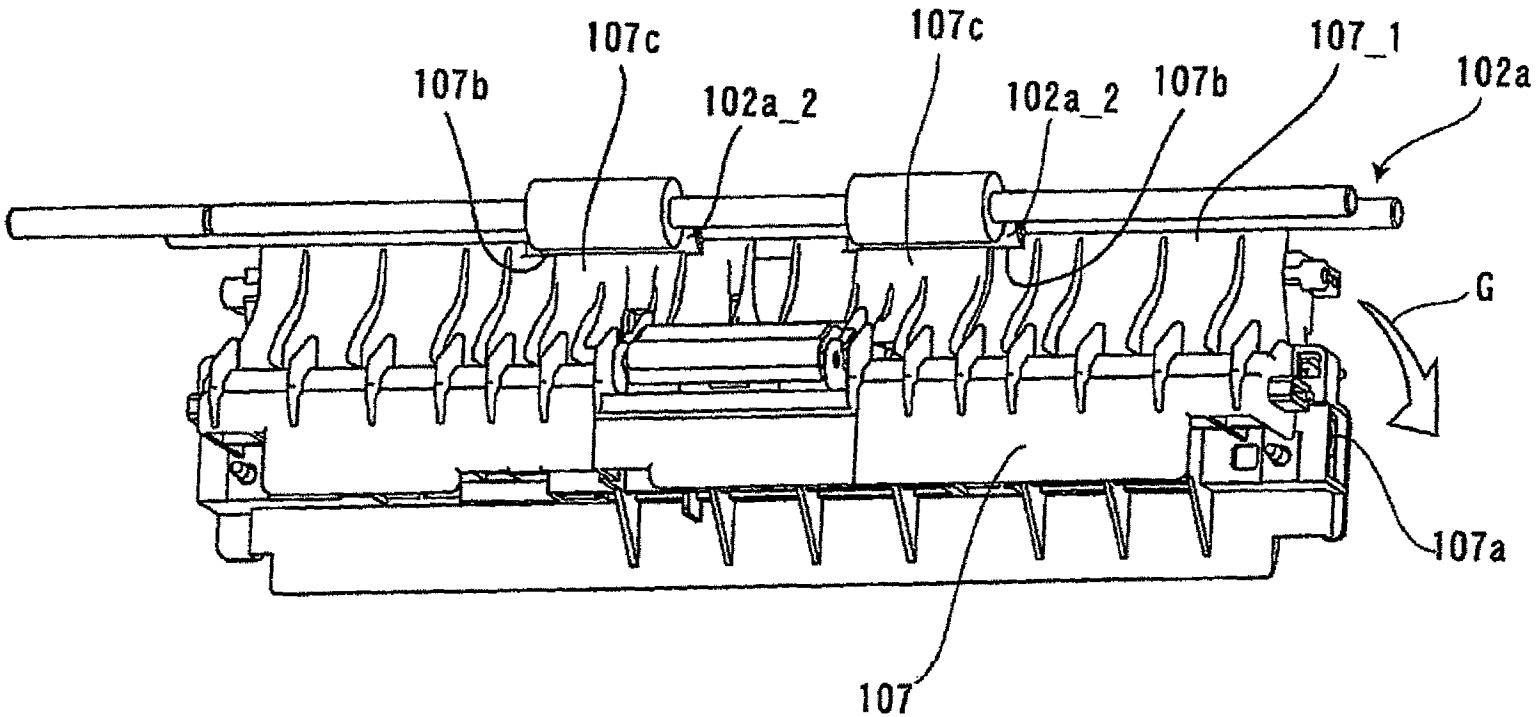
FIG. 9 is a perspective view illustrating the second movable guiding member, focusing on two notches formed at an end edge.

FIG. 9 is a perspective view illustrating the second movable guiding member, focusing on two notches formed at the end edge.

In FIG. 9, in order to easily show two notches 107*b*, the extracting roller 101 shown in FIG. 8 is omitted.

The notch 107*b* is provided in two portions of the end edge 107_1 of the second movable guiding member 107 that face the respective two first rollers 102*a*_2 in the first transport member 102*a*.

As described above, the second movable guiding member 107 rotates around the second rotation shaft 107*a* to the open posture in the arrow direction G when the jammed sheet is removed.

Figure 10:
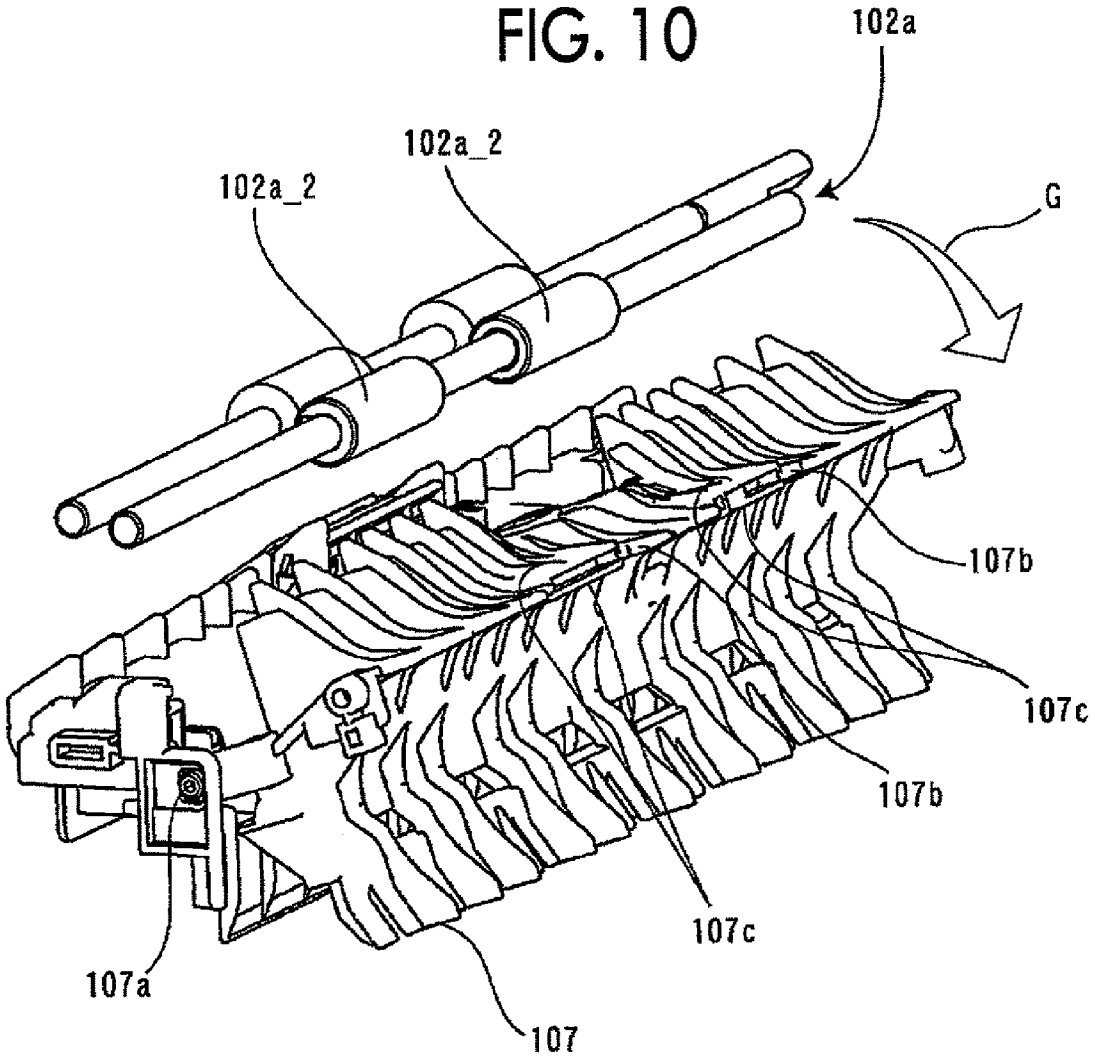
FIG. 10 is a perspective view illustrating the second movable guiding member in a state where the second movable guiding member rotates up to the open posture.

FIG. 10 is a perspective view illustrating the second movable guiding member that rotates up to the open posture.

As shown in FIG. 10, the arrow direction G where the second movable guiding member 107 rotates to the open posture is a direction where the second movable guiding member 107 declines to the side of the first transport member 102*a*.

Further, in this rotation, each of two first rollers 102*a*_2 in the first transport member 102*a* passes through the inside of each of two notches 107*b*. Thus, the second movable guiding member 107 rotates up to the open posture while not being in contact with two first rollers 102*a*_2.

Here, at a position of the second movable guiding member 107, adjacent to each notch 107*b* on an upstream side in the transport direction, on each of the sides of the first transport path R1 (see FIG. 3) and the sides of the second transport path R2 (see FIG. 3), a protrusion part 107*c* that protrudes in a direction where the transported sheet is pressed is formed.

In FIGS. 8 and 9, the protrusion part 107*c* of the second movable guiding member 107, formed on the side of the first transport path R1, is shown.

As described above, on the side of the first transport path R1 and the side of the second transport path R2, the second movable guiding member 107 has a structure in which the plural ribs that extend in the transport direction of the sheet are arranged in the direction that is across the transport direction. The protrusion part 107*c* protrudes and extends toward the side of the sheet, compared with these ribs.

Figure 11:
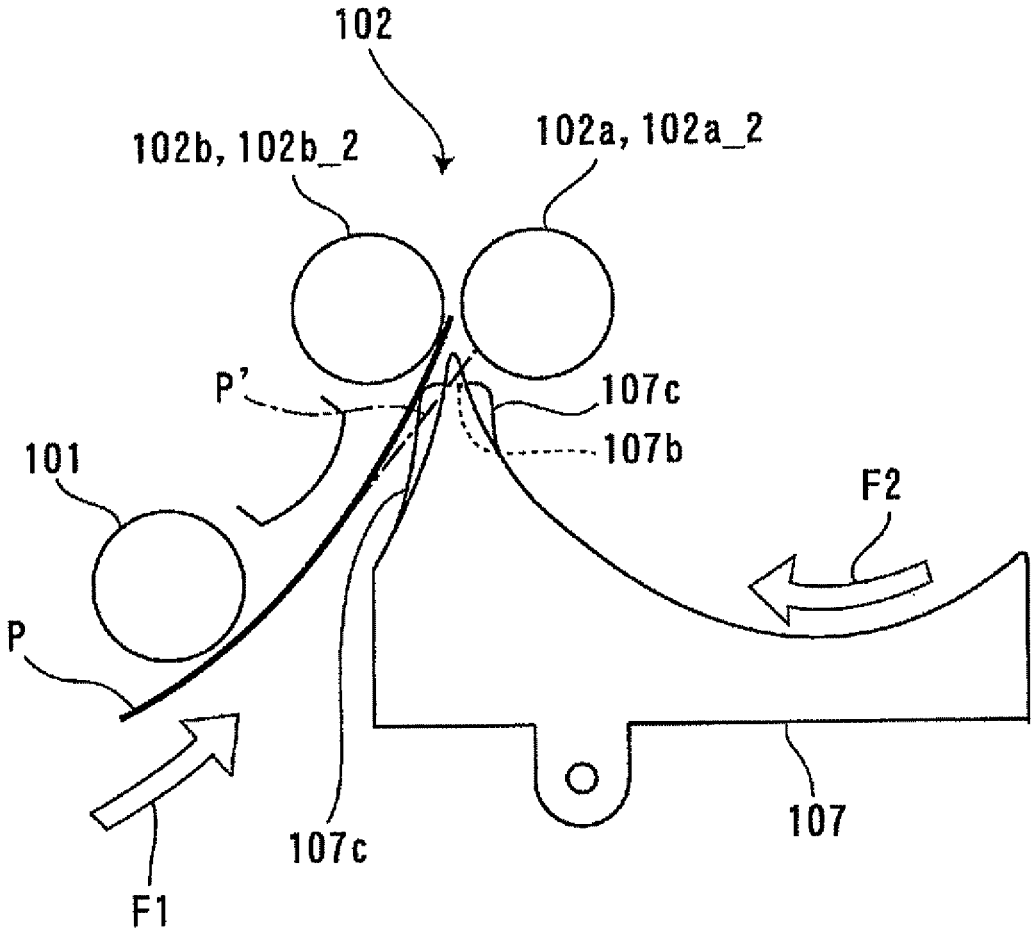
FIG. 11 is a side view schematically illustrating the second movable guiding member when seen in a direction of arrow in FIG. 8.

FIG. 11 is a side view schematically illustrating the second movable guiding member when seen from an arrow direction J in FIG. 8.

FIG. 11 shows an example in which the sheet P transported in the transport direction F1 on the first transport path R1 (see FIG. 3) by the extracting roller 101 is guided between the first transport member 102*a* and the second transport member 102*b* of the registration roller 102 by the second movable guiding member 107.

Here, assuming that the protrusion part 107*c* is not formed in the second movable guiding member 107, a portion of the sheet P transported in the transport direction F1, passed through the notch 107*b*, may fall into the inside of the notch 107*b*. Further, in a case where such a falling is present, the declined portion may be transported while being shifted toward the first transport member 102*a*, not between the first transport member 102*a* and the second transport member 102*b*.

In FIG. 11, a sheet P' in a state where the portion of the sheet P passed through the notch 107*b* declines to the inside of the notch 107*b* and is transported while being shifted toward the first transport member 102*a* is shown by a dotted line. The this way collides with a circumferential surface of the first roller 102*a*_2 of the first transport member 102*a*. At this time, if the first transport member 102*a* and the second transport member 102*b* are being rotated, the tip end of the portion that is transported being shifted in this way is also guided between the first transport member 102*a* and the second transport member 102*b* by the circumferential surface of the first roller 102*a*_2. However, the registration roller 102 repeat a transport stop state in which the transport is stopped while the tip end of the sheet is in a contact state and a transport state in which the sheet in the contact state is transported, in order to transport the sheet according to the time when the toner image is formed on the photoconductor drum 21 (see FIG. 3). Further, in many cases, the registration roller 102 enters the transport stop state when the sheet is transported from the extracting roller 101. Further, in the portion at the tip end of the sheet P that collides with the circumferential surface of the first roller 102*a*_2 of the first transport member 102*a* in such a transport stop state, deformation may occur due to the shock of collision.

Such a situation may similarly occur with respect to the sheet transported in the transport direction F2 on the second transport path R2. In the case of the sheet transported in the transport direction F2, the portion that declines to the inside of the notch 107*b* is transported while being shifted toward the second transport member 102*b*, and its tip end may collide with the circumferential surface of the second roller 102*b*_2.

On the other hand, in the present exemplary embodiment, at the position adjacent to the notch 107*b* on the upstream side in the transport direction, the protrusion part 107*c* is formed. The portion of the transported sheet P passed through the notch 107*b* is pressed by the protrusion part 107*c*, and is thus guided between the first transport member 102*a* and the second transport member 102*b*.

In the case of the example in FIG. 11, the portion of the sheet P passed through the notch 107*b* is pressed toward the second transport member 102*b* by the protrusion part 107*c*, and is thus guided between the first transport member 102*a* and the second transport member 102*b*.

With respect to the sheet transported in the transport direction F2 on the second transport path R2, the portion of the sheet P passed through the notch 107*b* is pressed toward the first transport member 102*a* by the protrusion part 107*c*, and is thus guided between the first transport member 102*a* and the second transport member 102*b*.

Further, in the present exemplary embodiment, as shown in FIGS. 8 and 9, the protrusion part 107*c* has one convex surface that is continuous in the axial direction, for each notch 107*b*.

As the protrusion part that presses the sheet, differently from the present exemplary embodiment, it may be considered that plural ribs are arranged in the axial direction. The protrusion part 107*c* in the present exemplary embodiment stably presses the portion of the sheet P passed through the notch 107*b* in a wide area, compared with a case where the sheet is pressed by the convex surface using the plural ribs.

Further, in the present exemplary embodiment, an example is shown in which the image forming apparatus 1 has the function of forming images on both sides of a sheet and the protrusion part 107*c* of the second movable guiding member 107 that guides the sheet transported on two transport paths is formed on the side of each transport path. However, for example, in a case where the image forming apparatus has the function of only forming an image on one side of the sheet and one transport path is present, the protrusion part may be formed on the side of one transport path of a guiding member that transports the sheet.

Further, in the present exemplary embodiment, an example is shown in which the guiding member that guides the sheet to the registration roller 102 is a movable guiding member and the protrusion part 107*c* is formed in the guiding member. However, for example, the guiding member that guides the sheet to the discharge roller may be a movable guiding member, and the protrusion part may be formed in the guiding member.

Further, in the present exemplary embodiment, a monochrome printer is shown as an example of the image forming apparatus. However, the image forming apparatus is not limited thereto, and may be a color printer. Further, the image forming apparatus is not limited to the printer, and may be a copier or a facsimile.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

APPENDIX (1) JP-A-2007-47571 (Corresponding to US20070036585)

JP-A-2007-47571 discloses an image forming apparatus having a mechanism that exposes, in a case where the sheet is jammed in any place on the first transport path or the second transport path, at least a part of the sheet in order to remove the jammed sheet.

What is claimed is:

1. A sheet transport device comprising:

a main body;

a first transport path through which a transported sheet passes;

a second transport path through which the sheet that passes through the first transport path and is reversed in a transport direction thereof passes until the sheet again enters the first transport path, having a curved portion on a downstream side thereof;

a first guiding member that forms a first guiding surface of the second transport path; and a second guiding member that forms a second guiding surface opposite to the first guiding surface formed by the first guiding member in the curved portion of the second transport path, wherein the first guiding member is supported to be rotatable between a guiding posture where the sheet is guided and an open posture that rotates from the guiding posture to open the guiding surfaces, and is configured to move so that an interval between the first guiding member and the second guiding member in the open posture is greater than that in the guiding posture.

2. The sheet transport device according to claim 1, wherein the second guiding member is supported to be rotatable between the guiding posture where the second guiding member forms the second transport path in cooperation with the first guiding member and the open posture that rotates from the guiding posture, wherein a rotation center of the first guiding member is disposed at a position that is distant from the curved portion compared with a rotation center of the second guiding member, and wherein the interval between the first guiding member and the second guiding member is increased as the positions of rotation shafts thereof vary when the first guiding member and the second guiding member respectively rotate to the open posture.

3. The sheet transport device according to claim 2, further comprising:

an opening and closing door that forms a part of an appearance of the sheet transport device, wherein the first guiding member is provided to be integrated with the opening and closing door and rotates to a position corresponding to the open posture from a position corresponding to the guiding posture according to an opening operation of the opening and closing door, and wherein the second guiding member rotates to a position corresponding to the open posture from a position corresponding to the guiding posture due to an own weight thereof according to the opening operation of the opening and closing door.

4. The sheet transport device according to claim 3, further comprising:

a third guiding member that forms a third guiding surface of an upstream transport path of the first transport path that is disposed on an upstream side with reference to a point where the first transport path merges into the second transport path, wherein the third guiding member rotates according to the rotation of the first guiding member from the guiding posture to the open posture to open the third guiding surface of the upstream transport path.

5. The sheet transport device according to claim 4, wherein the third guiding member forms a guiding member integrated with the second guiding member, and wherein the integrated guiding member opens both of the second guiding surface of the second transport path and the third guiding surface of the upstream transport path according to the opening operation of the opening and closing door.

6. An image forming apparatus comprising:

a main body;

an image forming unit that forms an image on a sheet being transported on a first transport path; and a sheet transport unit that reverses a transport direction of the sheet in which an image is formed on a first side thereof by the image forming unit while being transported on the first transport path, transports the sheet on a second transport path, through which the sheet passes until the sheet again enters the first transport path, having a curved portion on a downstream side thereof, causes the sheet to enter the first transport path on an upstream side with reference to the image forming unit, and transports the sheet on the first transport path again so that the image forming unit forms an image on a second side of the sheet, wherein the sheet transport unit includes:

a first guiding member that forms a first guiding surface of the second transport path, and a second guiding member that forms a second guiding surface opposite to the guiding surface formed by the first guiding member in the curved portion of the second transport path, and wherein the first guiding member is supported to be rotatable between a guiding posture where the sheet is guided and an open posture that rotates from the guiding posture to open the guiding surfaces, and is configured to move so that an interval between the first guiding member and the second guiding member in the open posture is greater than that in the guiding posture.

7. A sheet transport device comprising:

a main body;

a first transport path through which a transported sheet passes;

a second transport path through which the sheet that passes through the first transport path and is reversed in a transport direction thereof passes until the sheet again enters the first transport path, having a curved portion on a downstream side thereof;

a first guiding member that forms a first guiding surface of the second transport path; and a second guiding member that forms a second guiding surface opposite to the first guiding surface formed by the first guiding member in the curved portion of the second transport path and that forms a third guiding surface of an upstream transport path of the first transport path, wherein the first guiding member is supported to be rotatable between a guiding posture where the sheet is guided and an open posture that rotates from the guiding posture to open the guiding surfaces, and is configured so that an interval between the first guiding member and the second guiding member in the open posture is greater than that in the guiding posture, wherein the second guiding member is supported to be rotatable between the guiding posture and the open posture.

8. The sheet transport device according to claim 7, wherein the third guiding surface is disposed on an upstream side with reference to a point where the first transport path merges into the second transport path.

9. The sheet transport device according to claim 7, wherein the third guiding surface meets the second guiding surface at a point where the first transport path merges into the second transport path.

* * * * *